US005445379A

United States Patent [19]

Recore

[11] Patent Number: 5,445,379

[45] Date of Patent: Aug. 29, 1995

[54] GAME ACCESSORY FOR A DIVING BOARD

[76] Inventor: Francis R. Recore, P.O. Box 959, Yuba City, Calif. 95991

[21] Appl. No.: 266,215

[22] Filed: Jun. 27, 1994

[51] Int. Cl.[6] ..... A63B 63/08

[52] U.S. Cl. ..... 273/1.5 R; 273/411

[58] Field of Search ..... 275/1.5 R, 1.5 A, 411, 275/348, 402

[56] References Cited

U.S. PATENT DOCUMENTS

| | | | |
|---|---|---|---|
| 3,743,286 | 7/1973 | Weinhagen et al. | 273/1.5 R |
| 4,715,599 | 12/1987 | Raymond | 273/1.5 R |
| 4,717,150 | 1/1988 | Pribnow | 273/1.5 R |
| 4,973,054 | 11/1990 | Metrosky | 273/1.5 R |
| 5,149,086 | 9/1992 | Ziff | 273/1.5 R |
| 5,255,909 | 10/1993 | Wendell | 273/1.5 R |

*Primary Examiner*—Mark S. Graham

*Attorney, Agent, or Firm*—Bielen, Peterson & Lampe

[57] ABSTRACT

A game accessory for a diving board utilizing a support having a plate with an aperture. The diving board is passed through the aperture to support the plate in an upright position. A hoop is affixed to the vertical surface of the plate and extends outwardly from the diving board over the body of water. A brace is also employed in the present invention for supporting the plate in its vertical upright orientation. The brace derives support from the diving board.

6 Claims, 2 Drawing Sheets

FIG. 1
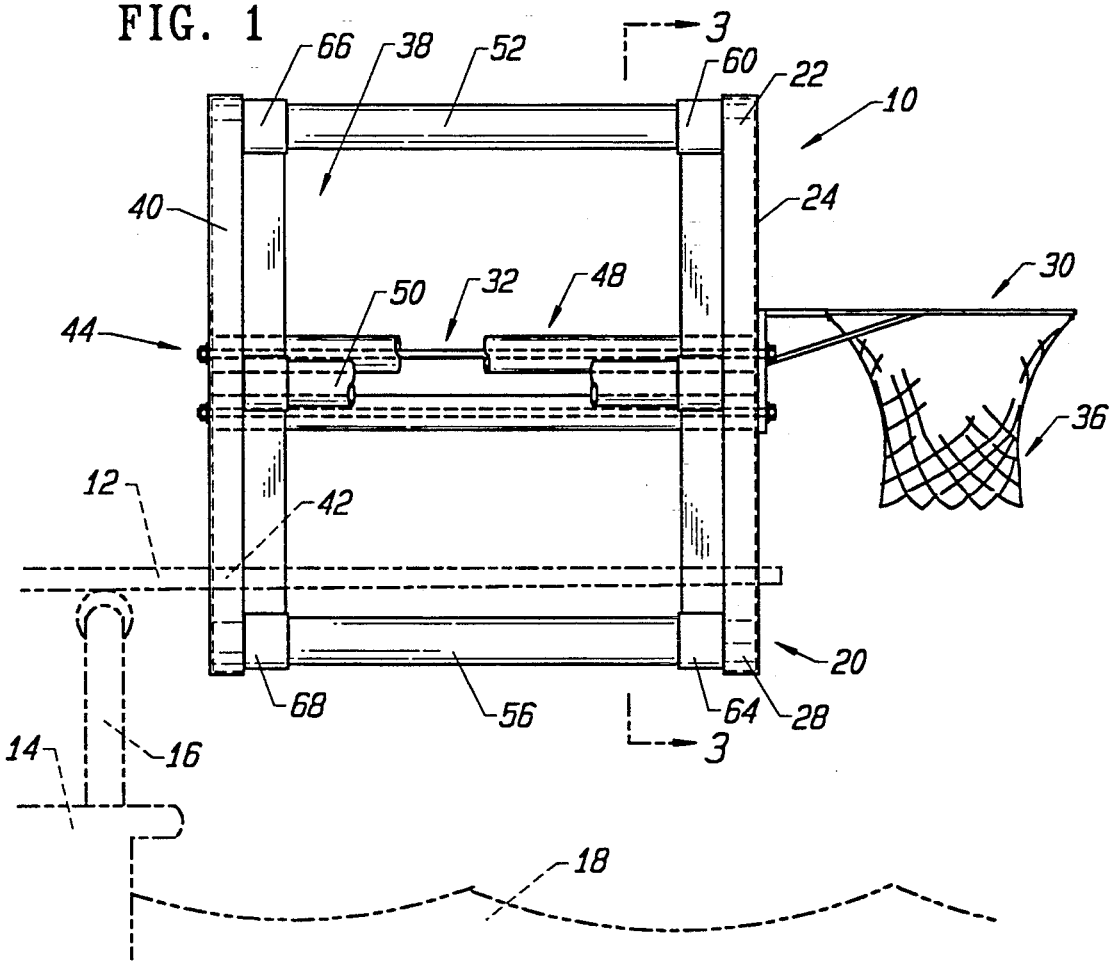
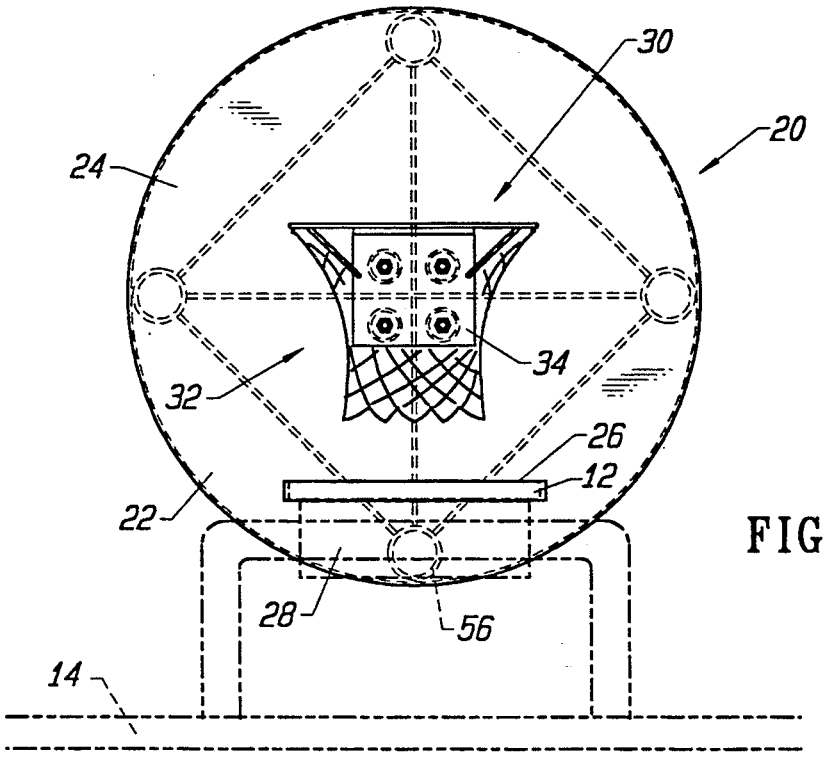
FIG. 2

GAME ACCESSORY FOR A DIVING BOARD

BACKGROUND OF THE INVENTION

The present invention relates to a game accessory for a diving board.

Water sports such as swimming, diving, water polo, and the like are increasing in popularity world wide. In particular, water polo is an olympic sport, but requires facilities which must be meticulously prepared in order to engage in such activity. Unfortunately, most swimming pools found in school facilities and at private residencies are not amenable to alterations which are necessary to play water polo or similar sports.

A game accessory which is usable in conjunction with a diving board found in many swimming pools in order to play a ball game would be a notable advance in the sports field.

SUMMARY OF THE INVENTION

In accordance with the present invention a novel and useful game accessory for a diving board is herein provided.

The accessory of the present invention includes a support having at least a first plate with an aperture through the same. The aperture is sized to pass a diving board through the same and to support the plate in an upright or vertical position relative to the diving board. The plate includes a surface which is oriented vertically with the supporting thereof by the diving board.

Brace means is also found in the present invention for maintaining the plate in a vertical orientation. Such brace means may take the form of a second plate having an aperture through the same which is also capable of passing the diving board therethrough. The first and second plates are spaced from one another along the diving board such that the first plate lies over the body of water of the pool associated with the diving board. Such brace means may further include connecting means for spanning the first and second plates. Spanning means may take the form of spanning members or rods which are substantially rigid and connected to the first and second plates. Each of the spanning members may be enclosed in a sleeve to protect the same from any interaction with the pool liquid, which tends to be corrosive. Spanning members may be located above and below the diving board in this regard.

A hoop is also found in the present invention and is affixed to the vertical surface of the first plate. The hoop, thus, extends outwardly from the diving board and over the pool. The hoop may be constructed of relatively flexible material and may be spring loaded to prevent injury to the players using the same.

It may be apparent that a novel and useful game accessory for a diving board is herein provided.

It is therefore an object of the present invention to provide a game accessory for a diving board which is quickly and easily attached to a diving board and gains support from the same for use with the pool associated with the diving board.

It is another object of the present invention to provide a game accessory for a diving board which permits the playing of a game similar to the game of basketball in a water environment.

Another object of the present invention is to provide a game accessory for a diving board which is vertically oriented and may be installed and removed from a diving board without altering the structure of the diving board in any manner.

A further object of the present invention is to provide a game accessory for a diving board which prevents its use for diving.

The invention possess other objects and advantages especially as concerns particular characteristics and features thereof which will become apparent as the specification continues.

BRIEF DESCRIPTION OF THE DRAWINGS

FIG. 1 is a side elevational view of the accessory of the present invention in place of a diving board over a pool.

FIG. 2 is a front elevational view of the game accessory of the present invention in place on a diving board.

Figure 3:
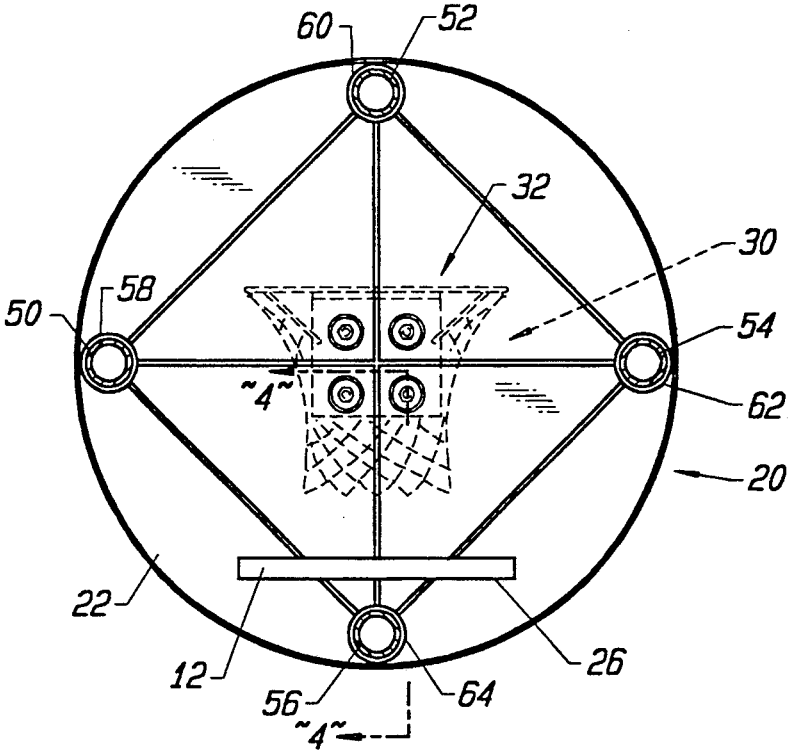
FIG. 3 is a sectional view taken along lines 3—3 of FIG. 1 of the device of the present invention in place on a diving board.

For a better understanding of the invention, reference is made to the following detailed description of the preferred embodiments thereof which should be referenced to the herein above described drawings.

DETAILED DESCRIPTION OF THE PREFERRED EMBODIMENTS

Various aspects of the present invention will evolve from the following detailed description of the preferred embodiments thereof which should be referenced to the prior described drawings.

The invention as a whole is depicted in the drawings by reference character 10. The game accessory 10 is used in conjunction with a diving board 12 partially affixed to pool perimeter 14 by cross bar 16. Of course, pool 14 includes a body of water 18 used for swimming and recreation in the conventional manner.

Accessory 10 includes as one of its elements a support 20 having a plate 22 with surface 24 that is oriented substantially vertically relative to diving board 12. Plate 22 includes an aperture 26 which extends through the same and is capable of passing diving board 12 therethrough, as depicted in FIGS. 1 and 2. Lower portion 28 of plate 22 lies below diving board 12. Hoop 30 is attached to plate 22 by the use of fasteners or spanning members 32 which penetrates bracket 34 of hoop 30. Hoop 30 includes a net 36 which is typical of a hoop used in the game of basketball. Hoop 30 extends outwardly over water body 18 to allow the users to toss a ball through the same.

Figure 4:
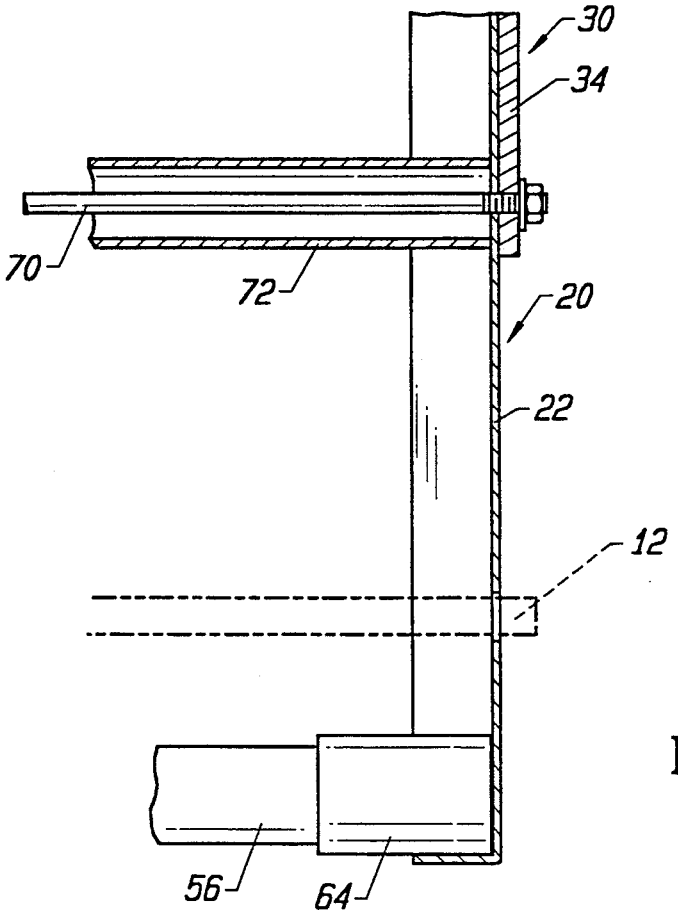
FIG. 4 is a sectional view taken along line 4—4 of FIG. 3.

Brace means 38 is also depicted in the accessory 10 for maintaining plate 22 in a vertical or upright orientation. Brace means 38 includes a second plate 40 having an aperture 42 which permits diving board 12 to pass through the same. In essence, plate 40 is substantially similarly constructed to plate 22, i.e., a round flattened configuration. Plurality of fasteners or spanning members 32 holding hoop 30 to plate 22 also extend to plate 40 and are held thereto by a multiplicity of caps or nuts 44, the latter being the case where the ends of plurality of fasteners or spanning members 32 are threaded. Quartet of sheaths 48 enclose a plurality of rod fasteners or spanning members 32 to prevent the same from being exposed to water from body of water 18 and other corrosive elements. Quartet of sheaths 48 are sandwiched between plates 22 and 44 or attached thereto by any conventional means such as glue, screws, and the like. Tubes 50, 52, 54, and 56 also span plates 22 and 40. Bosses or bushings 58, 60, 62, and 64 connected to plate 22 permit tubes 50, 52, 54, and 56 to be inserted therein and held to plate 22. Similar bosses are found on plate 40, bosses 66 and 68 being depicted in FIG. 1 (two others are not shown therein, but are similar to bosses 66 and 68 shown in FIG. 1). It should be apparent, that tube 56 lies below diving board 20. With reference to FIG. 4, it may also be observed that fastener 72 of plurality of fasteners 32 and sheath 72 of quartet of sheaths 48 lie above diving board 12. Plurality of fasteners 32 thus tightly hold plate 40 to plate 22 and serve as brace means 38 in combination with tubes 50, 52, 54, and 56.

In operation, the user slips plates 22 and 40 over diving board 12 through apertures 26 and 42, respectively. Surface 24 of plate 22 is maintained in an upright position with hoop 30 attached by fasteners 32 thereto, being located over body of water 18. Brace means 38 is then employed to support plate 22 in the position shown in FIG. 1 by the assemblage of tubes 50, 52, 54, and 56, as well as plurality of fasteners 32 within quartet of sheaths 48. Nuts or other fasteners 44 then employed at plate 40 to tighten the assemblage of plurality of fasteners 32 between plates 22 and 40. The accessory 10 is useable to play a basketball-type of game. Accessory 10 is removed from diving board 12 by reversing the above delineated steps.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A game accessory used in combination with a diving board associated with a pool, comprising:

a. a support including at least a first plate having an aperture therethrough for encompassing a diving board and supporting said plate to the diving board, said plate including a surface oriented substantially vertically relative to the diving board;

b. a hoop affixed to the vertical surface of the first plate to extend outwardly from the diving board; and c. brace means for maintaining said plate in a vertical orientation, said brace adapted to be connected to the diving board.

2. The game accessory of claim 1 in which said brace means comprises a second plate having an aperture therethrough for encompassing the diving board, said first plate being spaced from said second plate along the diving board, and connecting means for structurally tying said first plate to said second plate.

3. The game accessory of claim 2 in which said connecting means includes at least one spanning member connected to said first and second plates.

4. The game accessory of claim 3 in which said connecting means includes a plurality of spanning members connected to said first and second plates.

5. The game accessory of claim 3 in which the diving board includes upper and lower surfaces and said plurality of spanning members adapted to lie lie at the upper and lower surfaces of the diving board.

6. The game accessory of claim 4 in which each of said spanning members includes a surrounding sleeve.

* * * * *